United States Patent [19]

Stapleford et al.

[11] Patent Number: 4,779,209

[45] **Date of Patent: * Oct. 18, 1988**

[54] EDITING VOICE DATA

[75] Inventors: Gary N. Stapleford, Londonderry; Deane C. Osborne, Brookline, both of N.H.

[73] Assignee: Wang Laboratories, Inc., Lowell, Mass.

[ * ] Notice: The portion of the term of this patent subsequent to Dec. 2, 2003 has been disclaimed.

[21] Appl. No.: 913,178

[22] Filed: Nov. 17, 1986

Related U.S. Application Data

[63] Continuation of Ser. No. 439,210, Nov. 3, 1982, Pat. No. 4,627,001.

[51] Int. Cl.[4] ..... G10L 5/00

[52] U.S. Cl. ..... 364/513.5; 364/900

[58] Field of Search ..... 364/513.5, 900, 419

[56] References Cited

U.S. PATENT DOCUMENTS 4,375,083 2/1983 Maxemchuk ..... 364/900

FOREIGN PATENT DOCUMENTS

B70921/81 4/1981 Australia .
2082820 7/1981 United Kingdom .

OTHER PUBLICATIONS

P. D. Welch, System for Integrating IBM TDB, vol. 16, No. 2, Jul. 2, 1973, pp. 500–503.
Berney and Harshman, VoiceWare Does It Differently, Mini-Micro-Systems, Mar. 1982, pp. 183–193.

*Primary Examiner*—Emanuel S. Kemeny
*Attorney, Agent, or Firm*—Michael H. Shanahan; Gordon E. Nelson

[57] ABSTRACT

In a system for editing documents having text and voice components, portions of a document are selected by cursor control to display text characters and associated voice symbols or tokens representing the voice component position and time-length.

20 Claims, 2 Drawing Sheets

EDITING VOICE DATA

This is a continuation of application Ser. No. 439,210, filed Nov. 3, 1982 now U.S. Pat. No. 4,627,001 issued Dec. 2, 1986.

CROSS REFERENCE

Reference is made to a microfiche appendix containing 16 microfiche and 750 total frames.

BACKGROUND OF THE INVENTION

The invention relates to editing voice data.

SUMMARY OF THE INVENTION

The invention features a system for processing information having continuous signal acquiring means for acquiring a continuously varying electrical signal corresponding to voice message, digitizing means for digitizing said continuously varying electrical signal, to produce discrete voice data corresponding to the audible quality of said voice message, discrete data acquiring means for acquiring discrete data corresponding to alphanumeric characters, discrete signal acquiring means for acquiring discrete signals including editing and control commands, memory for storing data in discrete form, display means for creating visible display, and a processor, all being operatively interconected by control leads and data transfer channels, with an operating program for said processor being stored in said memory such that said processor controls the operation of said system so as to: store said discrete voice data in said memory concurrently with acquiring voice message, store said character data in said memory concurrently with entry of characters, establish a sequence record in said memory indicating a unified order of voice message and character data, display visibly a sequence of voice token marks and character marks, each token mark representing a predetermined increment of acquired voice message and each character mark corresponding to one of said entered characters, said displayed sequence corresponding to the sequence in said record, and revise, responsive to entered editing commands, said sequence record to reflect editing changes in the order of voice and character data.

The invention may additionally feature an operating program such that said processor additionally controls the operation of said system so as to: respond to predetermined discrete signals acquired concurrently with acquiring voice message, to indicate in the sequence record the point when each said predetermined discrete signals was acquired; display in said visible display a distinguishable indication of when each such concurrently acquired signal was acquired with respect to other elements of the voice data; establish in memory a pointer defining a pointer position in the sequence of data, display a visible mark in said display corresponding to said pointer position; move, responsive to input signals acquired, said defined pointer position in said sequence and correspondingly in said display; generate, responsive to input signals acquired, a continuously varying audio signal corresponding to said discrete voice data stored in memory, such generating starting at a point in said voice data sequence corresponding to said defined pointer position as then defined and following the order as then defined in said sequence record; and advance said pointer through said voice message data correspondingly to the progress of generation of audio signal. The invention may also feature circuitry for sensing audio acquisition activity and in absence of activity suppressing storing of voice message data in said memory.

The invention provides an author with a visible, graphic picture of the structure of his dictation with indications which he may insert of paragraph or other functional divisions. It permits an author to edit his dictation with great flexability: moving, deleting, inserting, and playing back while the display presentation helps him keep track of the editing and pin point where to make editing revisions. The invention also permits the author to enter from a keyboard interpolated notes and instructions into his dictated record.

DETAILED DESCRIPTION

Figure 1:
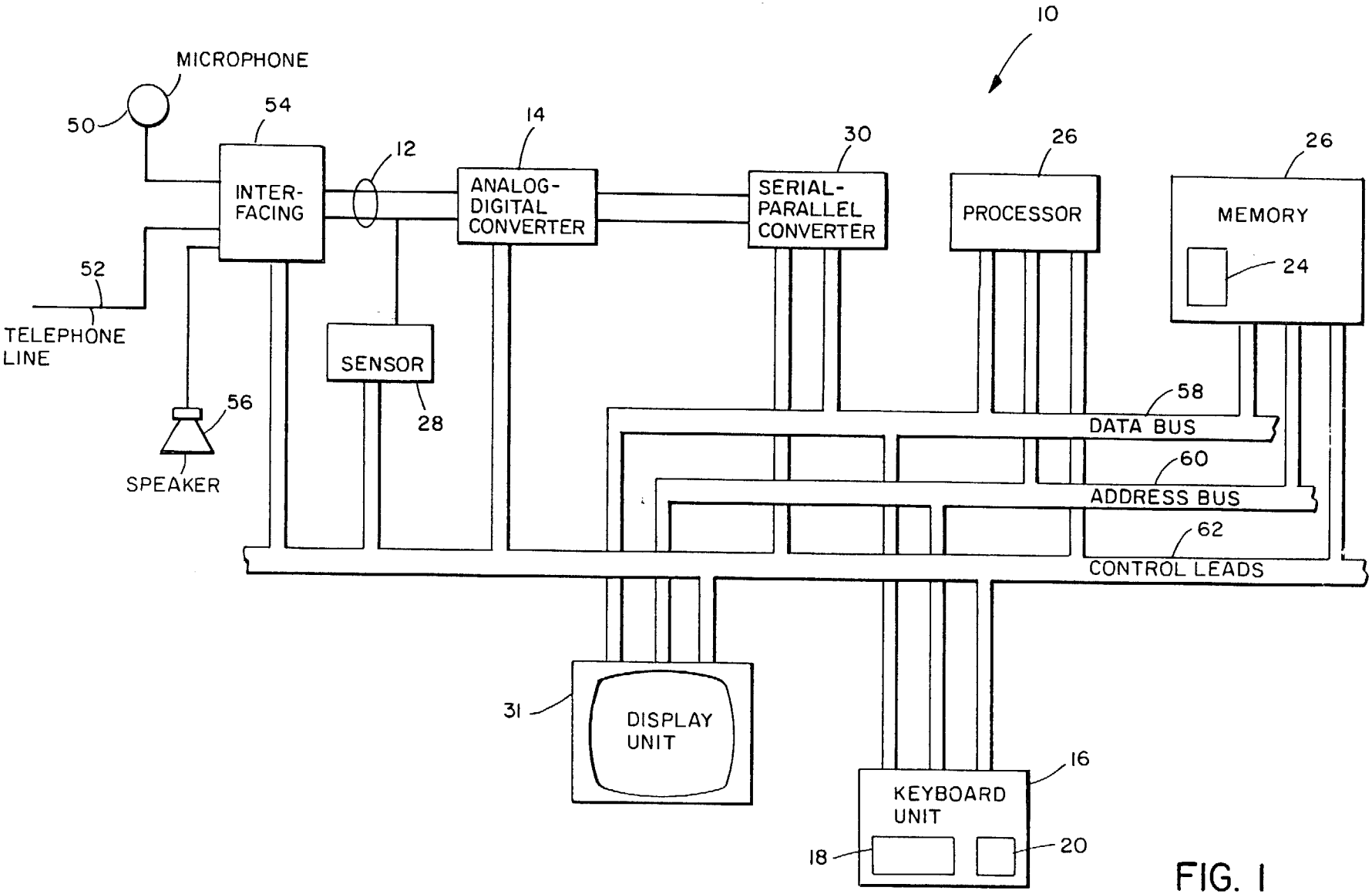
FIG. 1 is a block diagram of a system in which the invention is implemented.
Figure 2:
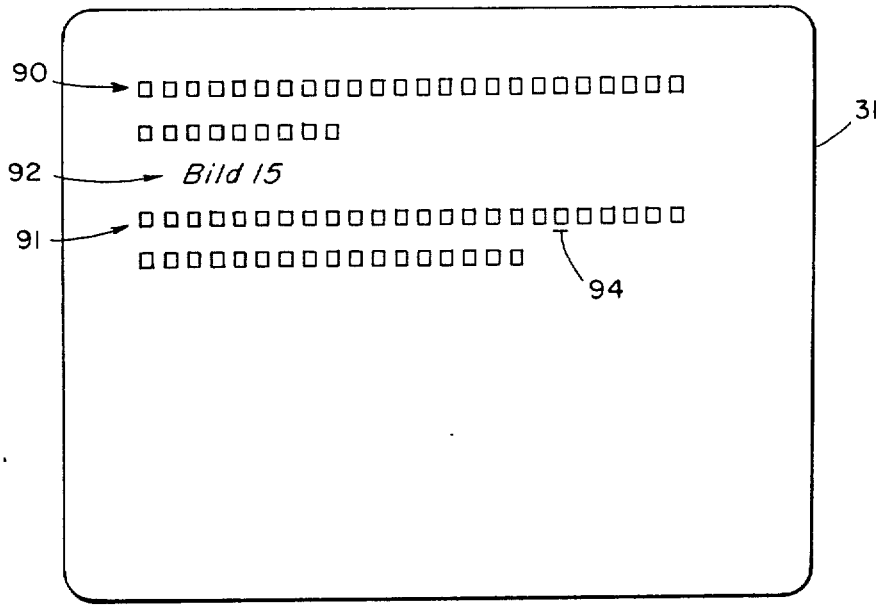
FIG. 2 is a display in the system of FIG. 1 showing the user interface of the invention.

Voice data editing system 10 according to the invention includes connections 12 for acquiring and delivering a continuously varying electrical signal corresponding to voice message. An acquired signal may be derived from a microphone 50, or a telephone line 52 operating through interfacing circuitry 54 as shown by way of illustration in the Figure, or in other ways. The delivered signal may be used to drive a speaker 56 as illustrated or in other ways. Connections 12 are connected to analog-digital converter 14, which converts in either direction. Converter 14 in turn connects to serial-parallel converter 30 operating in both direction. Audio sensor 28 is connected to connections 12 and functions to emit a control signal distinguishing when there is activity on the voice acquision channel. Also included in system 10 are visible display unit 31 which may advantageously include a CRT screen, and keyboard unit 16, which has a section 18 for entry of alphanumeric characters and a section 20 for entering editing and control signals.

System 10 also includes processor 26, which may be model Z-80 manufactured by Zilog and memory 22 for storing data in bit form and which has a section 24 which contains an operating program stored therein. All the elements of the system described above are interconnected through data bus 58, address bus 60, and control leads 62, as indicated in the Figure. All of the elements of system 10 described above are conventional commercially available items and the manner of interconnecting them is well known to those skilled in the word processing art.

The voice editor operating program stored in memory, in conjunction with the processor 26, controls the operation of the system in performing all of the voice editor functions. As an author using the system speaks into a microphone the voice message acquired by the system as an analog signal is digitized and entered into memory in discrete form. At the same time a representation of the voice message using a series of voice tokens 90 each representing one second of voice message is generated and displayed on the CRT. During voice pauses, entry of data is suppressed to avoid waste of memory capacity. Concurrently with dictating, the author may enter break signals at the keyboard which generate memory pointers indicating when in the data record the entry was made, and causing succeeding voice tokens to be displayed starting with the next display line, simulating a paragraph break. At the same time a marginal number is generated to permit easy identification of the break. The author may also with a keyboard-entered signal interrupt dictation and enter from the keyboard alphanumeric text. This text is entered into memory and displayed (92) on the CRT display.

The system operating under the control of the program maintains a record indicating a unified sequence of voice data, textual data, and break indications. Initially the order of this sequence is the temporal order in which the data is acquired by the system. The system also generates a memory pointer indicating a pointer position in the data sequence. A cursor mark (94) is displayed in the display at a corresponding position. The author can manipulate this linked pointer and cursor mark to designate any particular point in the unified data sequence. Using the cursor and keyboard editing signals including "insert", "delete", "replace", "move", and "copy", the author can effect all these editing functions, applying them indiscrimately as to whether the data is voice, textual or marks. The presentation in the display reflects all editing changes as they are made. The author can also, using the cursor and keyboard entered signals, cause playback of the voice message to any connected audio device.

A more detailed description of the program operation is given below and the program is set forth in the referenced appendix.

A voice editor operating program is stored in memory 22 and in conjunction with the processor 26 controls the operation of the system in performing all of the voice editor functions. The voice editor program makes use of a routine queue, and subroutines called by the voice editor are first thrown onto the routine queue, and subsequently executed when the processor gets around to it. With such a queue, an interrupt handler queues up a subroutine to deal with the interrupt, and then immediately reenables interrupts and returns. The subroutines get entered on the queue and are handled by the processor at its leisure. A routine queue module contains subroutines to manipulate the voice editor routine queue. They are:

RTN$QUE$INIT: Initializes the routine queue.

RTN$QUE$PUSH: Pushes a procedure address and an address parameter onto the routine queue.

RTN$QUE$RUN: Checks to see if a procedure/parameter pair is on the queue. If there is, it will call the procedure, passing it the single address parameter.

The main line voice editor program is quite simple because of the voice editor routine queue. The voice editor main line performs two functions: (1) It calls an initialization routine, voice$editor$init, to initialize all of the data structures and hardware io devices used by the voice editor. (2) It then loops forever, calling RTN$QUE$RUN to execute any subroutines on the routine queue. If the user indicates that he wants to exit the voice editor, for instance, the procedure EXIT$EDITOR is pushed onto the routine queue. The processor calls this routine as soon as it can, causing the voice editor to return to the calling application.

From the above discussion, it can be seen that once the voice editor is entered and it initializes variables and hardware, it just loops waiting for something to appear on the routine queue. Interrupt proceedures are used to put something on that queue. Interrupt procedures are run when a hardware interrupt occurs. When this happens, the processor disables interrupts, pushes the current program counter on the stack, and vectors to a procedure to handle the interrupt.

The voice editor runs in Z80 interrupt mode 2 and recieves interrupts from the following devices, listed in order of interrupt priority:

1. CTC channel 0 Block Count—this channel produces an interrupt when the audio hardware has just completed recording or playing a buffer of digitized audio.
2. CTC channel 1 Phone Ring—this channel produces an interrupt each time the telephone rings.
3. CTC channel 2 Keystroke—the voice editor programs this channel to interrupt every time a keystroke is received.
4. CTC channel 3 Timer—the voice editor programs this channel to interrupt every 10 ms (0.10 seconds).

The address of the interrupt handlers for the above devices are located in an interrupt vector table in memory. When any one of the above devices generates an interrupt, the corresponding address in the interrupt vector table is called.

The voice editor interrupt handers are found in two modules, the interrupt module and the io handlers module.

The interrupt module is just a bunch of assembly level routines, one for each interrupting device. They all save the registers on the stack, call a PLM procedure, and then restore the registers, enable interrupts and return. The handlers are:

audio: CTC channel 0 handler, calls PLM procedure AUDIO$INTERUPT.

ring: CTC channel 1 handler, calls PLM procedure RING$INTERUPT.

KEYHNDLR: CTC channel 2 handler, performs an IN (00) to get entered keystroke, saves this in variable RAWKEY, calls PLM procedure GOT$KEY.

timer: CTC channel 3 handler, calls PLM procedure TEN$MS$TIMER.

The io handlers module contains PLM procedures that do most of the interrupt handling. It also contains a few other miscellaneous routines. The interrupt routines are briefly described below:

RING$INTERUPT: Pushes a procedure onto the routine queue that will display the message 'Your phone is ringing, please press TAB'.

GOT$KEY: Typically just pushes procedure KEY$DISPATCH onto the routine queue. KEY$DISPATCH actual handles the keystroke.

TEN$MS$TIMER: Calls other PLM procedures which causes periodic checks on certain conditions.

Almost all voice editor functions are initiated when the user presses a keystroke. The voice editor uses a table-driven mechanism for deciding which procedure to call in response to a given keystroke.

The workstation keys are divided up into 16 different classes. Each class is assigned a number from 0 to 15. No key can appear in more than one class. The class numbers and keys in each class are listed below.

| Class Number | Description | Keys |
|---|---|---|
| 1 | record key class | INSERT |
| 2 | stop key class | STOP |
| 3 | play/stop key class | Space Bar, (HOME) |
| 4 | cursor class | North Cursor, East Cursor, South Cursor, West Cursor. |
| 5 | go to class | GO TO PAGE |

-continued

| Class Number | Description | Keys |
|---|---|---|
| 6 | number class | 0 through 9 |
| 7 | text class | A-Z, a-z, comma, period, ! #$%¢&*()-=+][; : '"? |
| 8 | back space class | Backspace Key |
| 9 | mark class | RETURN, NOTE |
| 10 | renumber class | |
| 11 | edit class | DELETE, REPLC, MOVE, COPY |
| 12 | execute class | EXECUTE |
| 13 | cancel class | CANCEL |
| 14 | help key class | COMMAND, (HELP) |
| 15 | phone key class | TAB |
| 0 | invalid key class | All other keys |

There is a translation table that converts raw hardware key is in sector into the corresponding class number (0–15). This table zero of the file 'VOICE.-CLASSTBL'. Sector one of this file contains the standard pre-WISCII keystroke translation table. It is important to note that the class table is shift-independent. Both CANCEL and SHIFT CANCEL are in the cancel class (13) for instance. This doesn't affect upper and lower case test characters, though, as both are in the text class (7).

The editor is divided into different operating states. The keys may have different meanings depending on the value of the current state , so for state a procedure table is defined. These procedure tables are called state tables. The state tables are defined in the state table module.

The voice editor state tables contain indexes into a large table of procedures. This table can be found in the routine table module containing 36 entries.

When first entering the editor, the main state is the current operating state. As new operating states come into effect, the old states, along with an index of the current prompt on the screen, are pushed onto a state stack. Let's say that while in the main state, the user presses the DELETE key. The main state is pushed onto the state stack and the segment definition state now becomes the current state. The prompt "Delete What?" appears on the screen.

Now assume the user presses the GO TO PAGE key. The segment definition state is pushed onto the stack, and the prompt is also pushed onto the state stack. The new state is the go to state. The prompt "Go to where" appears on the screen. The user types in a number, and presses EXECUTE. A procedure to go to the number is called.

At this point the segment definition state and the prompt is popped off the stack. The prompt "Delete What?" is again displayed on the screen. The user keys EXECUTE, and a procedure is called to delete the highlited portion of the voice file. The main state is then popped off the stack, and we are back to our original operating state.

In addition to the state tables themselves, the state table module also contains procedures to manipulate the state stack. These procedures are:

INIT$STATE: Initialize the state stack.

NEW$STATE: Pushes the old state onto the stack, makes the specified state the current state.

POP$STATE: Pops a state off of the stack, making it the current state.

The state table module also contains a routine that, given a class number, will return the address of the procedure that corresponds to that class for the current state:

ROUTINE$ADDR: Given a class, this procedure looks up in the current state table the address of the procedure that corresponds to that class.

The decision to call a particular procedure is summarized thus:

(1) Keystroke interupt (2) KEYHNDLR saves registers, putss hardware key code in variable RAWKEY, calls GOT$KEY.

(3) GOT$KEY performs the following:

(a) if a fatal error has occured, exit.

(b) if SHIFT$PAGE was typed, perform a dump.

(c) if we haven't processed the previous key yet, discard this one.

(d) push address of procedure KEY$DISPATCH along with parameter RAW$KEY on the routine queue.

(4) KEY$DISPATCH is popped off routine queue and executed, performing the following:

(a) translate keystroke using translation table.

(b) using class table, get class number for this key (c) If the high bit off the class number is zero, click on this keystroke.

(d) clear any error messages (e) With the exception of RETURN and play/stop class, stop the audio (f) Call ROUTINE$ADDR, passing it the class, to get the address of the procedure we should dispatch to.

(g) Push this procedure address and the translated keystroke onto the routine queue.

(5) The proper routine along with the translated keystroke are popped off the routine queue and run.

Further procedures can be roughly divided into two parts. There are low level modules for each data structure that perform operations on that structure. Typical lower level modules are the file index (audio index, mark table, note table), audio functions, and the screen.

The second part are the high level routines. These procedures are typically called by the keystroke dispatch mechanism (there addresses are in the routine table) and themselves call the lower level routines that do most of the work. Hence they can be thought of as an interface between the keystroke handling routines and the low-level workhorse procedures.

The user interface module (V:voice.rrr.plm-.ve.userint) contains high level audio, section marking, and renumbering procedures:

PLAY$STOP: Called whenever a key in the play/stop class is entered. If the audio is currently stopped, it moves the cursor to the beginning of the next audio sector and starts playing. If the audio is currently playing or recording, it stops the audio.

INSERT$MARK: Called when a key in the mark class is entered. If a section mark was entered, figures out it's exact position on the screen and calls the appropriate window module routine to enter it. If the note key was pressed, it checks to see if the cursor is currently on a note. If not, it creates one. In either case, text mode is entered.

RENUMBER: Called when a key in the renumber class is pressed. The editor is put in the renumber state and the prompt "Renumber Marks?" is displayed.

REN$EXECUTE: Called when EXECUTE is pressed while in the renumber state. Calls a mark table procedure to renumber the marks, redisplays the screen, and pops the previous state off the stack.

REN$CANCEL: Called when CANCEL is press while in the renumber state. Pops the previous state off the stack.

The backspace module implements the backspace function. Pressing the backspace key causes the cursor to back up five seconds and play for five seconds. Pressing N times causes the cursor to back up N * 5 seconds and play for the same amount of time. During playback, pressing any key other than backspace stops playback, completely canceling the backspace function. When the backspace key is pressed, there is 350 milliseconds before starting to play. This is so the user has time to repeatedly press the backspace key before playback starts. The backspace module uses three variables to accomplish these functions:

bs$mode TRUE if we are backspacing, FALSE other wise.

bs$time The cursor time when the user first pressed BACKSPACE. No matter how many times it is pressed, we will play up to but not beyond this position.

bs$play$cnt A counter decremented by the ten$ms$-timer. Used the count the 350 ms waiting time.

The backspace function exports the following procedures:

BS: Called when the backspace key is pressed. If first time pressed, set bs$mode to TRUE and remember bs$time. Initialize bs$wait$time to 350 ms.

BS$WAIT$COUNTER: Called every 10 ms by TEN$MS$TIMER. This procedure decrements bs$wait$time, and after 350 ms have elapsed, it pushes a procedure onto the routine queue that will play from the current cursor position to bs$time.

BS$KEY$CHECK: Called by KEY$DISPATCH, this procedure cancels backspace mode if a key other than backspace is entered.

The cursor module is has all of the high level cursor functions. Again, these procedures are just interfaces between the key dispatching and the screen routines that actually move the cursor around the screen.

CURSOR$RTN: Called in most states when a key in the cursor class is pressed. It just calls one of four screen routines, depending on which cursor key was pressed.

GO$TO$RTN: Called when the the GO TO PAGE key is pressed. It pushes the old state on to the stack and causes the current state to be the 'go to' state. It displays the "Go to Where?" prompt and moves the cursor to just after the prompt. Note that at message file translation time, this prompt should be right justified.

GO$TO$EXIT: This procedure is called when CANCEL is pressed while in the GO$TO$STATE. It repositions the cursor back in the audio/mark portion of the screen and pops the previous state of the stack.

GO$TO$CURSOR: Called when one of the cursor keys is pressed while in the 'go to' state. It calls one of four screen routines depending on which cursor key was entered. It then calls GO$TO$EXIT to return to the previous state.

GO$TO$ACCEPT$NUM: Called when a key in the number class is typed while in the 'go to' state. This procedure displays the number on the screen just after the prompt, and updates the cursor position.

GO$TO$EXECUTE: Called when EXECUTE is pressed while in the GO$TO$STATE. If there is a number on the screen, it converted from ASCII to binary and a screen routine is called to position the cursor underneath the appropriate mark. It then calls GO$TO$EXIT to return to the previous state.

The text entry module contains routines for entering text notes while in the test mode. The following variables are used:

text$buffer (60): buffer for holding the text note while entering it.

tindex: current position (0-59) in the text buffer.

tcursor: current screen position of the cursor note$index: index into the note table of the text note currently being worked on.

first: A flag, TRUE if the note being entered was just created. If it was, then if CANCEL is pressed, we will delete this note. If it is an old note being modified, then pressing CANCEL will just restore the note to its original form.

The following routines are exported:

TEXT$SET$FIRST: Called by INSERT$MARK to tell the text entry module that this note was just entered.

TEXT$MODE$ENTER: Called by INSERT$MARK when the NOTE key is pressed. Pushes old state, sets up new 'text' state. Displays prompt "Enter Text". Grabs note from note table, puts it in text buffer.

TXT$CANCEL: Called when CANCEL is pressed while in the 'text' state. If we have been entering a new note, this note is deleted. Otherwise we discard the text buffer, and redisplay the screen with the old note intact. Restores previous state.

TEXT$EXECUTE: Called when EXECUTE is pressed while in the 'text' state. Replaces the old note with the contents of the text buffer. Restores previous state. TEXT$CURSOR: Called when a cursor key is pressed while in the 'text' state. Moves the cursor forward or backward. Displays error message if North Cursor or South Cursor is pressed.

TXT$BACK$SPACE: Called when the backspace key is pressed while in the 'text' state. Moves cursor back one position, then erases the character it is under.

TXT$ENTRY: Called when a key in the text, number, or play/stop class is pressed. Enters the character into the text buffer and onto the screen and advances the cursor one position.

TEXT: Called when a text key is hit in while in the 'main' state. If the cursor is on a note, it enters text mode and enters the struck key into the text buffer and onto the screen. If the cursor is not over a note, it displays the message "Move Cursor".

The edit module provides an interface between the key dispatch mechanism and the lower level screen in file index rountines that actually perform the manipulations on the file.

The edit module keeps track of what parts of the file are being edited. A point structure is used to located positions in the file. This structure is of the form:

```
point structure    (
    time           address,
    index              byte)
```

where time is the elapsed time into the file, and index is the mark index of the current, or if there is no mark at this position, the next mark in the file.

The following point structures are used to keep track of positions while editing:

begpoint: the begining of a segment to delete/move/-copy
endpoint: then end of a segment to delete/move/copy
destpoint: the destination point for a move/copy.

To delete a portion of the file, the segment between begpoint and endpoint (inclusive) is removed from the file:

To move or copy a portion of the file, the segment between begpoint and endpoint (inclusive) is moved or copied to destpoint:

When inserting into the file, destpoint gets the insertion point. The current end of file in begpoint, recording is started at the end of the file:

When the user presses STOP, the program performs a move as described above, moving the segment delimited by (begpoint, endpoint) to destpoint.

To replace a segment of the file, three additional point structures are used:
rbegpoint: contains the beginning of the segment to delete.
rendpoint: contains the end of the segment to delete.
rbegpoint: contains the beginning of the segment to insert.

The replace procedure works as follows: Initially we define the segment to replace between begpoint and endpoint. After the segment is defined, we copy begpoint to rdestpoint, endpoint to rendpoint, and set the rbegpoint to the end of file. We then go through the standard insert procedure, recording at the end of the file. As with insert, when STOP is keyed, the new material, segment (begpoint, endpoint), is moved to the insertion point, destpoint, completing the insert. During the replace, the user can insert, play, move the cursor keys, and enter section marks and text notes. All inserts are performed in the normal way, using begpoint, endpoint, and destpoint. Of course, all inserts are restricted to beyond rbegpoint.

If the user presses CANCEL, the replace is canceled by reseting the end of voice file time to rbegpoint, restoring the file to it's original form.

If the user presses EXECUTE, the replace is executed by first deleting the segment (rdestpoint, rendpoint) and then assigning rdestpoint to destpoint, and the end of file to endpoint and then performing the insert by using a normal move of the segment (begpoint, endpoint) to destpoint.

The audio functions module contains routines to play and record into voice files. It makes use of a companion module, the io module which contains data structures and procedures to manipulate the buffers and queue requests to the master.

When playing or recording, audio data must be buffered so that playing or recording is not interrupted by waiting for a buffer write or read to complete. The audio workstation software is designed use at least two buffers, but more may be used as space allows. Currently, the audio workstation uses 6 audio buffers.

The voice editor uses buffers that are from one to 16 sectors in length. These buffers are page aligned in memory. Each buffer corresponds to an audio block in the voice file. The io module contain structures called info structures, that manage the audio buffers. The io module contain a io request queue, which is used to queue up RCBs. The ten ms timer checks this queue every 10 ms. If something is on it, the timer procedure itself will pop the request off the queue and present it to the master.

The io request queue uses the following data structures:
queue: an array of addresses, this is the io request queue.
top: index of the top of the queue
bottom: index of the bottom of the queue
count: the number of elements in the queue The following routines manipulate the queue.
IO$PUSH: Push the address of an RCB onto the io request queue.
POP$AND$SEND If there is anything on the queue and the SCA is clear, pop the RCB address off the queue and put it in the SCA. This procedure is called whenever we first push something on the queue (try to pop it off immediately). It is also called every 10 ms by the TEN$MS$TIMER procedure.

Because the voice editor only inserts recorded data, it does not overstrike, recording always starts at the end of the file. Inserted data is recorded at the end of the file and then moved to the insertion point.

To record, the following steps are performed:
(1) start with the 6th info structure.
(a) fill in the first buffer address
(b) fill in the buffer size
(c) if we are recording into the last block in the file, set the stop flag.
(2) give the hardware the address of the first buffer
(3) tell the hardware to start recording.
(4) Perform this procedure:
(a) tell the hardware the size of the buffer it is currently recording into.
(b) Queue up a write request for the preceding buffer, if this is not the first buffer.
(c) If stop flag is set for this buffer, stop.
(d) Check to see that any past write request for this buffer have completed, if not, stop the audio until the request has completed.
(e) Fill in the RCB for this buffer.
(f) Increment variables so that we are ready to process next buffer.

After hardware finishes recording into the first buffer, a block count interrupt is generated (CTC channel 0). When this occurs, the procedure AUDIO$INTERUPT is called. This procedure checks to see if play or record mode is in effect, and calls a play or record interrupt procedure. Step (4), above, is the record interrupt procedure, RECORD$INTERUPT. As recording progresses, it gets called every time a buffer completes.

Playback is similar to record. We perform some initialization, and then tell the hardware to start playing. Immediately we call the PLAY$INTERUPT routine. As each buffer is played out, PLAY$INTERUPT is called again to prepare the next buffer for playback and queue up a request to read another buffer from the disk.

When recording, the sample rate is always set to the literal SMP$RATE, which defines the sampling rate. During playback, however, the sample rate can be changed. Every 10 ms, the procedure SET$RATE is called by the TEN$MS$TIMER procedure. This procedure calls a routine to convert the current setting of the speed control to the appropriate sample rate. The hardware is then given the value of this sample rate.

The voice editor screen is divided up into two sections, the status portion and the audio/mark portion. The status portion consists of the first two lines and the last line of the screen. This area is used for displaying prompts, the cursor time, length, etc. The audio/mark portion, which consists of lines 3 through 21, is used to display the contents of the voice file, i.e. the audio blocks, text notes, and section marks.

The display module controls the status portion of the screen. In addition, all MENUPACK procedures are found in this module. It contains procedures to initialize menupack, display the cursor time, audio mode, help reminder, phone mode, title, prompts, length, and error messages.

The window module contain the routines to display and update the audio/mark portion of the screen. This module is assisted by the following modules:

| | | |
|---|---|---|
| convert | (V:voice.rrr.plm.ve.convert) | Positional structure conversion routines |
| time | (V:voice.rrr.plm.ve.time) | Time-position conversion routines |
| line | (V:voice.rrr.plm.ve.line) | Line structure implementation |
| region | (V:voice.rrr.plm.ve.region) | Editing indexes finder |
| scroll | (V:voice.rrr.plm.ve.scroll) | Low level window manipulations |

The voice file consists of a header, mark table, note table, sector map and block map. The following modules contain routine to access the voice file:

| | | |
|---|---|---|
| fileindx | (V:voice.rrr.plm.ve.fileindx) | File index implementation |
| editindx | (V:voice.rrr.plm.ve.editindx) | File index editing operations |
| mark | (V:voice.rrr.plm.ve.mark) | Mark table implementation |
| note | (V:voice.rrr.plm.ve.note) | Note table implementation |
| voicegrm | (V:voice.rrr.plm.ve.voicegrm) | Voice file create, initialize and clean up routines |
| extend | (V:voice.rrr.plm.ve.extend) | Voice file extend and truncate routines |
| fatal | Fatal error, ABEND handler | |

The Error Module contains procedures for ABENDs, fatal errors and non fatal errors. A flag, DUMPFLAG, set in the link, is used to determine whether an error will result in a dump or not. If DUMPFLAG is 0FFh, then dumps are enabled. If it is 0, then dumps are disabled.

The exported procedures are:

NON$FATAL$ERROR: Dump if flag set, display VE error: XXX, where XXX is a passed in error number. These error numbers are defined in (V:voice.rrr.lit.-ve.ERR). Also display 16 byte data portion (typically an RCB) if passed as a parameter.

INFORM$ERROR: Display non-VE error message, after any key is hit, return to calling application. Non VE error messages are just the standard errors such as "Move Cursor" that are displayed on the lower portion of the screen. These are defined in (V:voice rrr.lit.ve.MERROR).

FATAL$ERROR: Identical to NON$FATAL$ER-ROR except that this is non recoverable. After the user presses any key, the editor returns to the caller.

The voice editor recovery mechanism will recover from workstation power failures or inavertant IPLs during the recording proccess. The voice editor makes use of some common data structures, and three modules contain implementations of and routines to manipulate these structures.

The routine queue uses these procedures:

QUE$INIT: This procedure defines a queue. The user specifies the address of the queue, the size of the queue, the size of each element in the queue and a pointer to a structure which holds all of the salient features of the queue. This structure identifies the queue. It must be passed as a parameter to the push and pop routines described below.

QUE$PUSH: This procedure pushes an element onto a specified queue.

QUE$POP: This procedure pops an element off the head of a specified queue.

The stack module (V:voice.rrr.plm.ve.stack) is an implementation of a stack with push and pop routines. The state table module stack uses procedures from the stack module to implement the state stack. Unlike the queue module, the stack module routines can only operate on a single stack, defined in the module as follows:

stack (12): byte The space reserved for the stack.

sp: The stack pointer.

Two routines manipulate the stack:

PUSH: Push an element onto the the stack.

POP: Pops an element off of the stack.

The bit map module (V:voice.rrr.plm.ve.bit) can set, clr, and test bits in a user specified bit map. The map cannot be larger than 256 bytes. The mark table uses a bit map to determine the number of the next section mark to create. The file index editing module uses a bit map to order all free blocks in the index so that file extends are performed optimally. The bit map module contains the following procedures:

BIT$SET: Sets a bit in a bit map.

BIT$CLR: Clears a bit in a bit map.

BIT$TEST: Tests a bit to see if it is set or cleared.

All of the PLM INPUT and OUTPUT statements for the voice editor are contained in the audio hardware control module (V:voice.rrr.plm.ve.audioctl). This module contains small procedures that act as an interface between the hardware and the bulk of the voice editor PLM code.

The set interrupt mode module (V:voice.rrr.z80.ve.-setimode) contains two procedures, one to set up the workstation for interrupt mode 2 and the other to reset it back to interrupt mode 0. The PLM routines, INIT$-WORKSTATION and RESET$WORKSTATION, found in the audio hardware control module, call the two routines in the set interrupt mode module. The very first bytes of this module contain the interrupt vector tables for the CTC and PIO. These tables must reside on a factor-of-eight boundary in memory, so care must be taken in the link map.to see that this is done.

We claim:

1. In a system for storing documents having text and voice components and including display means, document display means for displaying a representation of a portion of one of the documents on the display means comprising:

text display means for displaying a representation of a text component belonging to the portion;

voice component position indicating means for indicating the position of a voice component belonging to the portion relative to the text component by indicating a position relative to the text display means; and voice component length display means for displaying the length in time of the voice component.

2. In the document display means of claim 1 and further comprising:

movable current position display means for marking a current location in the voice component length display means corresponding to a current position in the voice component.

3. In the document display means of claim 2 and wherein:

the display means include cursor control means; and the current position display means, the current location marked thereby, and the corresponding current position move in response to the cursor control means.

4. In the document display means of claim 2 and wherein:

the current position display means further marks a current location in the text display means, in which case the current position is in the text component; and the document storage system includes command input means for inputting a command specifying a function which may be performed at any location in the document and command execution means responsive to the command and the current position for performing the specified function at the location in the document specified by the current position.

5. In the document display means of claim 4 and wherein:

the command specifies an editing function.

6. In the document display means of claim 5 and wherein:

the document storage system includes means for receiving input material including voice material and text material; and the editing function is insertion of the input material into the document at the current position.

7. In the document display means of claim 6 and wherein: the editing function additionally includes replacement of material in a portion of the document indicated by the current position display means with the input material.

8. In the document display means of claim 5 and wherein: the editing function is deletion of material in a portion of the document indicated by the current position display means.

9. In the document display means of claim 5 and wherein: the editing function is moving material indicated by the current position display means to a location indicated by the current position display means.

10. In the document display means of claim 5 and wherein: the editing function is copying material indicated by the current position display means to a location indicated by the current position display means.

11. In the document display means of claim 4 and wherein:

the specified function is performed at a location in the component relative to the current position.

12. In the document display means of claim 2 and wherein:

the document storage system further includes audio means for playing the contents of a voice component;

the display means further includes command input means for receiving a play command; and the document storage system responds to the play command by playing the contents of the voice component containing the current position beginning at the current position.

13. In a system for storing documents having text and voice components, means for editing a stored document comprising:

display means for displaying a representation of a component of the document;

movable current position means in the display means for marking a current location in the representation corresponding to a current position in the component;

command input means for receiving a command specifying a function which may be peformed at any location in the document; and command execution means for responding to the command and the current position by performing the specified function at the location in the document specified by the current position.

14. In the document display means of claim 13 and wherein: the command specifies an editing function.

15. In the document display means of claim 14 and wherein:

the document storage system includes means for receiving input material including voice material and text material; and the editing function is insertion of the input material into the document at the current position.

16. In the document display means of claim 15 and wherein: the editing function additionally includes replacement of material in a portion of the document indicated by the current position display means with the input material.

17. In the document display means of claim 14 and wherein: the editing function is deletion of material in a portion of the document indicated by the current position display means.

18. In the document display means of claim 14 and wherein: the editing function is moving material indicated by the current position display means to a location indicated by the current position display means.

19. In the document display means of claim 14 and wherein: the editing function is copying material indicated by the current position display means to a location indicated by the current position display means.

20. In the document display means of claim 13 and wherein: the specified function is performed at a location in the component relative to the current position.

* * * * *